United States Patent [19]

Arene et al.

[11] Patent Number: 4,932,308

[45] Date of Patent: Jun. 12, 1990

[54] LIGHT WEAPON SYSTEM OR LAUNCHER WITH A RECOILING TUBE

[75] Inventors: Francois Arene; Thierry Cuenot, both of Paris, France

[73] Assignee: Societe d'Etudes de Realisations et d'Applications Techniques, Paris, France

[21] Appl. No.: 169,421

[22] Filed: Mar. 17, 1988

[30] Foreign Application Priority Data

Apr. 3, 1987 [FR] France ..... 87 04731

[51] Int. Cl.[5] ..... F41F 23/06; F41F 3/02

[52] U.S. Cl. ..... 89/37.01; 89/1.705; 89/42.01

[58] Field of Search ..... 89/1.54, 1.51, 1.704, 89/1.705, 1.706, 1.701, 1.7, 42.01, 37.01

[56] References Cited

U.S. PATENT DOCUMENTS

| | | | |
|---|---|---|---|
| 432 | 10/1837 | Bubier | 89/37.01 |
| 42,630 | 5/1864 | Ward | 89/42.01 |
| 2,489,747 | 11/1949 | Burney | 89/1.704 |
| 2,967,460 | 1/1961 | Musser | 89/1.51 |
| 2,979,991 | 4/1961 | Buschers et al. | 89/1.51 |
| 4,012,987 | 3/1977 | Burkhalter et al. | 89/1.701 |

FOREIGN PATENT DOCUMENTS

| | | |
|---|---|---|
| 2470358 | 5/1981 | France . |
| 2534681 | 4/1984 | France . |

*Primary Examiner*—David H. Brown

*Attorney, Agent, or Firm*—Sandler, Greenblum & Bernstein

[57] ABSTRACT

A weapon system including a carriage and a launching tube for a projectile mounted to the carriage on a cradle in a manner which secures the launch tube to the cradle during transportation, handling and storage and yet permits recoil of the launching tube. Bosses having the shape of stubs are attached to the launching tube and bosses having the shape of mortices forming grooves on the cradle form complementary pairs of elements which connect the launching tube transversely with respect to the cradle without opposing the recoil of the launching tube; the cradle thus forms a zero length ramp for the launching tube. Removable reinforcement pins are provided to secure the launching tube to the cradle. The bosses and the reinforcement pins are placed symmetrically with respect to a central longitudinal axis of the launching tube.

16 Claims, 3 Drawing Sheets

LIGHT WEAPON SYSTEM OR LAUNCHER WITH A RECOILING TUBE

BACKGROUND OF THE INVENTION

1. Field of the Invention

This invention relates to a light weapon system or launcher with a recoiling tube, for example antitank mines or projectiles.

2. Discussion of Background and Material Information

The known light launchers are generally based on concepts for minimizing the recoil momentum applied to them when launching the projectile thus rendering them capable of firing from a light carriage, and even from the shoulder.

Representative examples of such light weapon systems include rocket launchers and "recoilless" guns. In such cases, the rockets are self propelled by reaction. The recoil momentum caused by launching the projectile from a recoilless gun is balanced by the ejection in the reverse direction either of the combustion gases or of a ballast generally divided. Major improvements in this latter type of light weapons system or launcher have been the object of the following patents and patent applications registered in the name of the present owner in France:

79 28 780 filed on Nov. 22, 1979 and published under No. 2 470 358;

82 17 460 filed on Oct. 19, 1982 and published under No. 2 534 681;

85 06 939 filed on May 7, 1985 and published under No. 2 581 742;

86 10 680 filed on Jul. 23, 1986 for "Improvements to projectile recoilless weapons or launcher systems", published under No. 2 602 040.

However, the adaptation of the rockets to light launchers usually requires the use of short combustion durations. These induce an extra cost in proportion with the difficulty of mastering such combustion laws: hence the necessity of using a propergol of high characteristics having its elements formed with a precise geometry and firmly connected to the structure.

On the other hand, the known recoilless guns have a relatively large mass due to the extra mass corresponding to the compensation of the recoil.

This is the reason why the present invention provides a light launcher in which the mass as well as the cost of the system are simultaneously reduced.

SUMMARY OF THE INVENTION

The invention relates to a light launcher weapon or weapon system with a recoilless tube, to be used against tanks, mines or projectiles, such as missiles, which includes an aiming or preaiming carriage, a launching tube closed at its rear portion, a projectile with a propulsion charge, characterized in that the launching tube is connected to the carriage via a cradle arranged in such manner as to allow, after firing the propulsion charge, the disconnection of the tube from the cradle and its free recoil, at least during the main portion of distance covered by said projectile inside the bore of said tube.

As one will appreciate it, the weapon system according to the present invention allows obtaining a recoil of the launching tube which is as free as possible by eliminating the carriage reactions likely to degrade the firing accuracy, in accordance with the present invention the recoiling tube and the carriage are disconnected in a simple and economical way. Moreover a recoil compensation device is not required, thus greatly reducing the mass of the launcher. Light weapons systems or launchers in accordance with the present invention are particularly well adapted to mines or mortar launchers which have to be installed in great numbers on the field when the safety at the rear of the launcher is not so important.

Nevertheless and in accordance with the present invention, the recoiling tube can be fitted out with extra elements adapted to braking the launching tube, after ejection of the projectile, and thereby reducing the importance of the rear effects of the proposed system.

BRIEF DESCRIPTION OF THE DRAWING

Other features and advantages of the invention will become more apparent from the description of an embodiment which reference the annexed drawing. It should be made clear, however that the annexed drawing serves only as a non-limiting example and that any other modes of construction, shapes, proportions, arrangements can also be used without departing from the scope of the invention.

The description of the embodiment of the invention, of its organization and of its operation will become more apparent from the accompanying drawings wherein.

Figure 1:
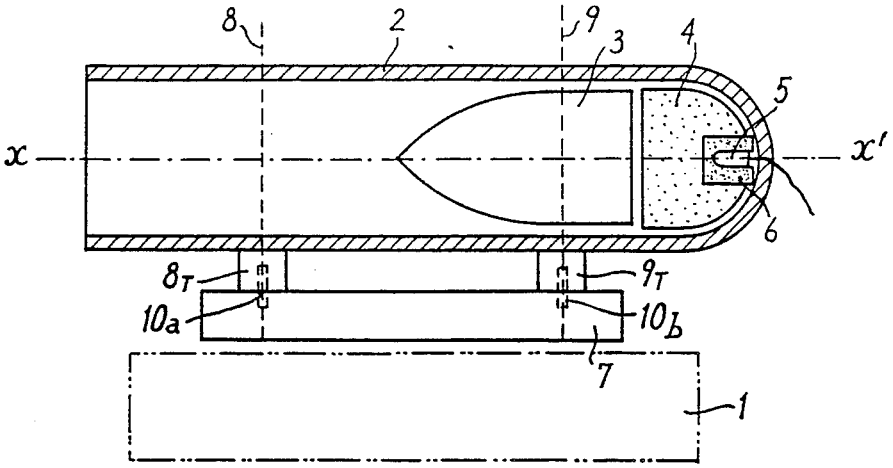
FIG. 1 shows the whole assembly of the light weapon system or launcher with a recoiling tube which is the object of the invention.

The embodiment shown in the drawings can correspond in particular to the case of a mine, or of an antitank mine launcher system, which can be aimed or preaimed and operated from a distance. When refering to FIG. 1, one sees that the system includes a carriage 1, a launching tube 2 closed at its rear portion and enclosing the projectile or antitank mine 3, launched towards the target by combustion of a propulsive charge 4, for example a mass of propergol, under the effect of an igniter 5 and of an ignition relay 6.

Figure 9:
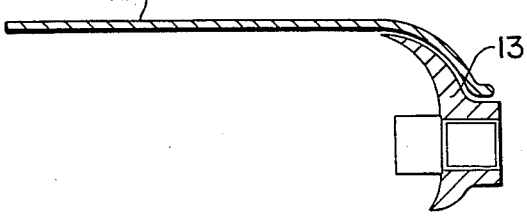
FIG. 9 shows an embodiment wherein the launch tube is made of composite material having been wound or coiled on a rear insert.

The launching tube 2 is preferably made of composite materials 12' wound on a rear insert 13, shown more clearly in FIG. 9. It can also be formed of a single element or several elements adapted for being connected to each other or spreaded out.

Still according to the invention and as shown in FIG. 1, prior to firing and until firing the shot, tube 2 is rigidly connected to carriage 1 used for the aiming or preaiming, via a cradle 7.

To this effect, bossings or dosses are formed on tube 2, and possibly also on carriage cradle 7 in distinct sections, preferably in two sections, one in a front section 8 and one in the rear section 9. Moreover, the launching tube is connected to the cradle via shear pins such as pins 10*a*, 10*b* . . . or 10 (FIG. 2), wherein the pins are adapted to shear off on firing. In order to reduce the shearing energy and to reinforce the connection of tube 2 to cradle 7 during transportation, handling and storage, the system according to the present invention can also include removable reinforcement pins 12 to be remove when placing the system in position.

Figure 2:
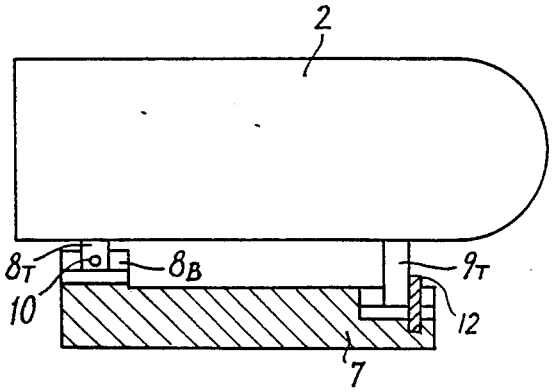
FIGS. 2, 3 and 4 make more apparent the mounting arrangements of said recoiling tube in its cradle.
Figure 3:
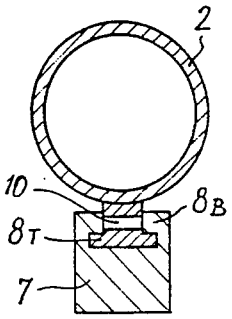
Figure 4:
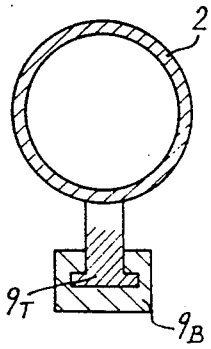
Figure 2B:
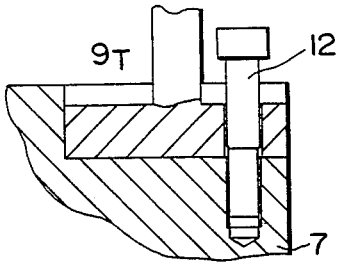
FIG. 2*b* shows the embodiment illustrated in FIG. 2 provided with a reinforcing pin.

FIGS. 2, 3 and 4 show with more precision the arrangements of said bosses for a first embodiment of the invention.

Prior to firing, each tube boss, such as 8T, is in register with a boss of the cradle such as cradle boss 8B. The launching tube bosses such as 8T and 9T form stubs embedded in the cradle bosses of cradle 7, such as 8B and 9B, in the shape of mortices or fork joints. According to this embodiment of the invention, the stub/mortice pairs are on the same side of launching tube 2 and they are grooved for holding the launching tube transversely with respect to the cradle.

Of course, the invention can be carried out with other arrangements, notably as regards the research of a symmetry, with respect to a longitudinal axis x'x of tube 2 of the connection between launching tube 2 and cradle 7 for minimizing the carriage reactions.

Figure 5:
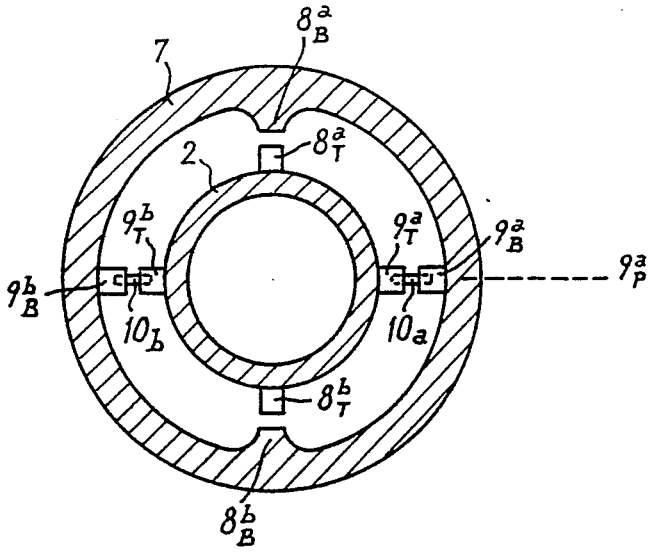
FIGS. 5 and 6 show alternative embodiments of this mounting.
Figure 6:
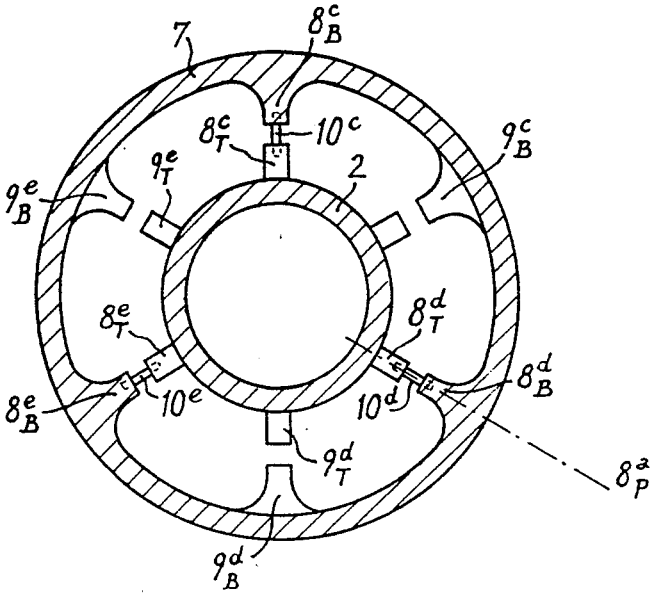

Thus, according to the alternative embodiment shown in FIG. 5, two pairs of bosses are placed opposite each other at 180° in each of sections 8 and 9, whereas according to the alternative embodiment of FIG. 6 three pairs of bosses are spaced apart by 120° in each of the front and the rear sections.

Moreover, for the three embodiments of the invention which are shown in FIGS. 2 to 6, the bosses of the rear section 9 are radially offset with respect to those of the front section 8: this offset being an orientation or spacing offset radially with respect to the longitudinal axis x'x.

The accuracy of the orientation of launching tube 2 with respect to cradle 7 depends on the spacing of bosses in sections 8 and 9 and of the adjustment of the pairs of bosses such as 8T, 8B or 9T, 9B.

To this end and according to the present invention, the spacing of the bosses should be greater than a caliber and preferentially of the order of 2 to 4 calibers whereas the fit is preferably "sliding".

On firing, and according to the invention, launching tube 2 is transversely freed from cradle 7 as soon as its recoiling length exceeds a relatively small value of the order of one tenth of a caliber for example.

To this end, the length (measured parallel to axis x'x) of the bosses of launcher tube 2 and of cradle 7, such as 8T and 8B or such as 9T and 9B, are preferably on the order of one tenth of a caliber. The cradle, therefore, forms with respect to the tube a "zero length ramp".

Given the arrangement of the system shown by said examples, one sees that on firing, tube 2 is maintained with respect to cradle 7 transversely by bossings and longitudinally by shearing pins: a pin 10, i.e., pins 10*a* and 10*b*, for the example of FIG. 2; two "opposed" pins at 180° 10*a*, 10*b* for FIG. 5; and three pins spaced apart by 120°, i.e., 10*c*, 10*d*, 10*e* for the example of FIG. 6.

According to the invention, the shearing pins are made of a light alloy or of a glass/resin composite, their section or thickness being defined so as to ensure connection regardless of environment stresses which may be experienced including for example falls, jerks and vibrations.

Given the arrangement of the invention, on firing igniter 5 and then of relay 6 and of the propulsive charge 4, tube 2 is subjected to a recoil force exerted by the gases on its rear portion.

During recoil, tube 2 shears the pins such as 10*a*, 10*b*, and slides in the bearing surfaces formed by pairs of bosses such as 8T and 8B. After a distance covered of the order one tenth of the caliber, said bearing surfaces are entirely cleared. Tube 2 is then entirely free of any interaction with the carriage thus the aforementioned orientation or spacing offsets between the bosses of sections 8 and 9 to prevent any impact or interaction between the tube front bosses such as 8T and the carriage rear bosses, such as 9*b*.

Thus, after ejection of the projectile or antitank mine 3, and according to the invention, tube 2 is thrown rearwardly and recoils entirely freely, with a great momentum which is substantially equal to the sum of that of the projectile plus that of the bore gases.

The reduction of the magnitude of the rear effects can of course be of interest, including the case of mine launcher systems.

To this effect, in order to reduce the recoil of tube and according to a variant of the invention, some pieces of equipment such as aiming or target detection devices maybe mounted rigidly on tube 2; preferably on either side of the axis of the tube so that the centre of gravity of said recoiling mass remains as close as possible to the central longitudinal of the launching tube axis x'x.

Figure 7A:
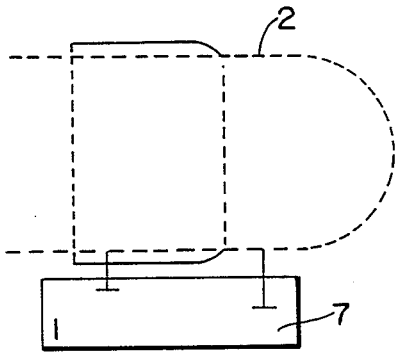
FIG. 7*a* shows an embodiment wherein the means for reducing recoil is a parachute in an initial state.
Figure 7B:
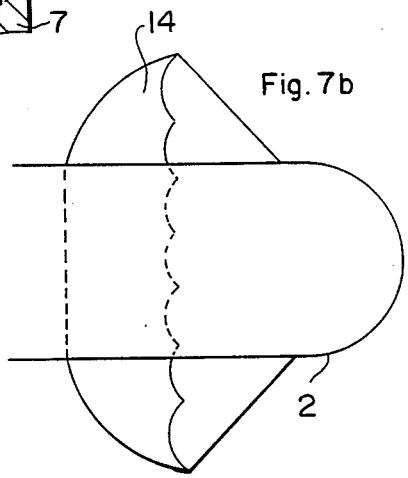
FIG. 7*b* shows an embodiment wherein the parachute is in an actuated state.

Moreover, as shown in FIGS. 7*a* and 7*b* the system according to the invention can be completed by fitting out tube 2 with aerodynamic systems, such as parachute 14 canopies or air brake flaps, capable of being spread out, preferably after the ejection of the antitank projectile or mine 3, so as to reduce or strongly deflect, without disturbing the projectile, the remaining speed of tube 2 so as to reduce the importance of the rear effects of the examplary system of the invention.

Figure 8A:
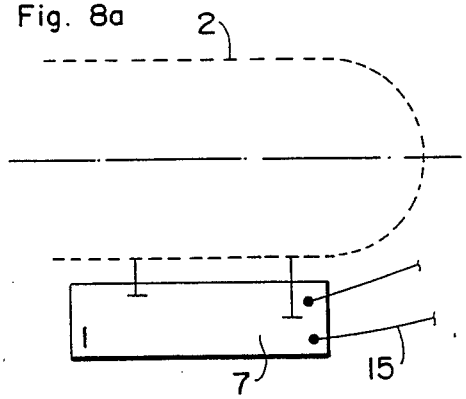
FIG. 8*a* shows an embodiment wherein the means for recoil is in the form of straps or cables in an initial state.
Figure 8B:
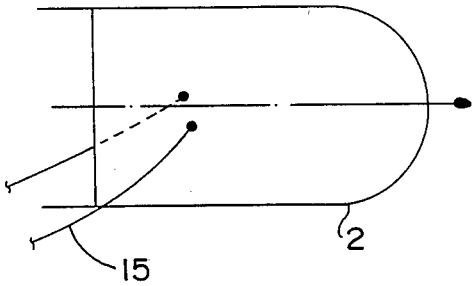
FIG. 8*b* shows an embodiment wherein the straps and cables are in an actuated state.

According to the invention, the braking or deflection effect can also be obtained by a connection of tube 2 to carriage 1 or to its cradle 7 which is established only after the ejection of projectile 3: this connection being shown in FIGS. 8*a* and 8*b* for example as carried out by using straps or cables.

Finally and according to the invention, tube 2 can also form with the carriage and its cradle 7 a "disposable" assembly corresponding to the so-called "consumable weapon" concept.

However, and according to a variant of the invention, tube 2 can also form with the antitank projectile or mine 3 as well as with the pyrotechnic elements 4, 5 and 6 a "complete round" capable of being mounted by the users themselves on the cradle of carriage 7, this corresponding to the "rechargeable weapon" concept.

It is obvious that the present invention is not limited to the embodiments shown hereabove and that it encompasses all alternatives thereof.

What we claim is:

1. A weapon system comprising a launching tube with a bore having a projectile therein powered by a propulsive charge, said launching tube being closed at a rear portion; a cradle for slideably mounting said launching tube to allow recoil of said launching tube during a main portion of distance covered by said projectile in the bore of said launching tube; bosses and pins for securing said launching tube transversely and longitudinally with respect to said cradle; wherein said bosses comprise: (i) bosses attached to said launching tube having the shape of stubs and (ii) bosses on said cradle having the shape of mortices forming complementary grooves so as to allow a longitudinal sliding movement of said launching tube during recoil of said launching tube, wherein said cradle forms a zero length ramp for said launching tube.

2. A weapon system according to claim 1, wherein said bosses have a minor dimension parallel to a longitudinal axis of said launching tube.

3. The weapon system according to claim 1, wherein said launching tube comprises composite materials.

4. A weapon system according to claim 1, wherein said pins are shear pins.

5. A weapon system according to claim 4 wherein said shear pins comprise a glass/resin composite.

6. A weapon system according to claim 4, wherein said shear pins comprise a light alloy.

7. A weapon system according to claim 1, wherein said bosses comprise front bosses located on a front section and rear bosses on a rear section of said launching tube, said rear bosses being transversely offset with respect to said front bosses.

8. A weapon system according claim 1, wherein front bosses are placed in said front section and said rear bosses are placed in said rear section symmetrically with respect to a longitudinal axis of said launching tube, said rear bosses of said rear section being situated in bisecting planes of said front section.

9. A weapon system according to claim 7, wherein said front bosses on said front section and said rear bosses on said rear section are spaced apart by a distance equal to about two to four calibers of said launching tube.

10. The weapon system according to claim 9, wherein one of said bosses and one of said pins are placed diametrically opposite another of said bosses and another of said pins in each said front section and in each said rear section.

11. The weapon system according to claim 9, wherein three said bosses are placed in said front section and three said bosses are placed in said rear section.

12. A weapon system according to claim 1, further comprising means for minimizing recoil of said launching tube operably connected to said launching tube.

13. The weapon system according to claim 12, wherein said means for minimizing recoil comprises a member selected from the group consisting of aerodynamic elements and retention elements.

14. The weapon system according to claim 13, wherein said retention elements are selected from the group consisting of straps and cables.

15. The weapon system according to claim 13, wherein said aerodynamic elements are selected from the group consisting of parachutes and canopies.

16. The weapon system according to claim 15, wherein said aerodynamic elements are parachutes.

* * * * *